US007175322B2

(12) United States Patent
Tanaka

(10) Patent No.: US 7,175,322 B2
(45) Date of Patent: Feb. 13, 2007

(54) VEHICLE HEADLAMP

(75) Inventor: Hidetaka Tanaka, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/289,529

(22) Filed: Nov. 30, 2005

(65) Prior Publication Data

US 2006/0164850 A1 Jul. 27, 2006

(30) Foreign Application Priority Data

Nov. 30, 2004 (JP) ..... P. 2004-346516

(51) Int. Cl.
*F21W 101/10* (2006.01)

(52) U.S. Cl. ..... 362/517; 362/297; 362/298; 362/299; 362/302; 362/346

(58) Field of Classification Search ..... 362/507, 362/516, 517, 518, 297, 298, 299, 301, 302, 362/303, 304, 305, 346
See application file for complete search history.

(56) References Cited

U.S. PATENT DOCUMENTS 6,796,696 B2 * 9/2004 Taniuchi ..... 362/539
2003/0090906 A1 * 5/2003 Hayakawa ..... 362/517
2004/0141330 A1 * 7/2004 Takada ..... 362/516

FOREIGN PATENT DOCUMENTS

JP 2001-229715 A 8/2001
JP 2002-313112 A 10/2002

* cited by examiner

*Primary Examiner*—Laura K. Tso
(74) *Attorney, Agent, or Firm*—Sughrue Mion, PLLC

(57) ABSTRACT

At an upper position of an optical axis Ax between a reflector and projection lens, a pair of left and right first additional reflectors are arranged and a pair of second additional reflectors are arranged on both the left and right sides of the pair of first additional reflectors. Each one of the first additional reflectors reflects light from the light source toward one of the second additional reflectors located on a side opposite to the one of the first additional reflector with respect to the optical axis. Each one of the second additional reflectors reflects, in a forward direction, the light reflected from the first additional reflectors without being transmitted through the projection lens.

7 Claims, 11 Drawing Sheets

VEHICLE HEADLAMP

The present application claims foreign priority based on Japanese Patent Application No. P.2004-346516, filed on Nov. 30, 2004, the contents of which are incorporated herein by reference.

BACKGROUND OF THE INVENTION

1. Field of the Invention

The present invention relates to a projector type of vehicle headlamp.

2. Related Art

Generally, a projector type of vehicle headlamp is provided with a projection lens arranged on an optical axis extending in a longitudinal direction of a vehicle, and a light source arranged behind a rear focal point of the projection lens. The light emitted from the light source is reflected toward the optical axis.

Disclosed in JP-A-2001-229715 is a projector type of vehicle headlamp in which at a lower position of an optical axis between a reflector and a projection lens, a first additional reflector is arranged for upward reflecting the light emitted from a light source, and at the upper position of the optical axis, a second additional reflector is arranged for forward reflecting the light reflected from the first additional reflector without being transmitted through the projection lens.

By the first and second additional reflectors, a part of the light not used in an ordinary headlamp can be effectively used as forward projecting light.

However, in the vehicle headlamp of JP-A-2001-229715, since the first and second reflectors are arranged in singularity, respectively, the light flux of the light emitted from the light source cannot be sufficiently used.

SUMMARY OF THE INVENTION

One or more embodiments of the present invention provide a projector type of vehicle headlamp which can accurately control forward projected light, and can also enhance a light flux using rate of the light emitted from a light source, by arranging first and second additional reflectors as a pair, respectively in a predetermined positional relationship.

In accordance with one or more embodiments of the present invention, a vehicle headlamp is provided with: a projection lens arranged on an optical axis extending in the longitudinal direction of a vehicle; a light source arranged behind a rear focal point of the projection lens; a reflector for reflecting light emitted from the light source toward the optical axis; a pair of left and right first additional reflectors arranged at an upper position or lower position of the optical axis between the reflector and projection lens; and a pair of left and right second additional reflectors. In the vehicle headlamp, the left second additional reflector is arranged on a left side of the left first additional reflector, and the right second additional reflector is arranged on a right side of the right first additional reflector. In the vehicle headlamp, the left first additional reflector reflects the light from the light source toward the right second additional reflector, and the right first additional reflector reflects the light from the light source toward the left second additional reflector. In the vehicle headlamp, the second additional reflectors reflect the light from the first additional reflectors, in a forward direction, without being transmitted through the projection lens. In the vehicle headlamp, the left first additional reflector has a reflecting face formed in a ellipsoidal shape (an ellipsoid of revolution) with a first focal point in the vicinity of the light source and a second focal point between the left first additional reflector and the right second additional reflector, and the right first additional reflector has a reflecting face formed in a ellipsoidal shape (an ellipsoid of revolution) with a first focal point in the vicinity of the light source and a second focal point between the right first additional reflector and the left second additional reflector.

A distributed light pattern formed by the vehicle headlamp may be a distributed light pattern for a low beam (lower beam), a distributed light pattern for a high beam (upper beam), or any other distributed light pattern.

The kind of the above "light source" should not be particularly limited, but may be for example, a discharging portion of a discharging bulb, or a filament of a halogen lamp.

Each of the "first additional reflectors" should not be particularly limited in its specific arrangement and in a specific position of the second focal point of its ellipsoidal shaped reflecting face as long as it is designed to reflect the light from the light source toward the second additional reflector located on the side opposite to the first additional reflector with respect to the optical axis and its reflecting face is formed in a ellipsoidal shape (ellipsoid of revolution) which has a first focal point at a point in the vicinity of the light source and a second focal point at a point located between the first additional reflector and the corresponding second additional reflector.

Each the "second additional reflectors" should not be limited in a specific shape of its reflecting face and its arrangement as long as it is designed to forward reflect the light without being transmitted through the projection lens.

The second additional reflector corresponding to the first additional reflector means the second additional reflector on which the light from the light source reflected by the first additional reflector is incident.

As understood from the structure described above, the vehicle headlamp in accordance with one or more embodiments of the present invention is designed as a projector type of vehicle headlamp. And, at an upper position or lower position of the optical axis between the reflector and projection lens, a pair of left and right first additional reflectors are arranged and a pair of second additional reflectors are arranged on both the left and right sides of the pair of first additional reflectors; each the first additional reflectors is designed to reflect the light from the light source toward the second additional reflector located on the side opposite to the first additional reflector with respect to the optical axis and each the second additional reflectors is designed to forward reflect the light from the light source reflected from each the first additional reflectors without being transmitted through the projection lens. In accordance with such a configuration, the greater part of the light not effectively used in the ordinary projector type of vehicle headlamp can be effectively used as forward projected light. Thus, the distributed light pattern formed by the light projected by the vehicle headlamp can be formed as a composed distributed light pattern consisting of a basic distributed light pattern formed by the light forward projected through the reflector and projection lens and a pair of additional distributed light patterns formed by the light forward projected through the pair of first additional reflectors and the pair of second additional reflectors.

In the vehicle headlamp, since the reflecting face of each of the first additional reflectors is formed in a ellipsoidal shape having the first focal point at the point in the vicinity of the light source and the second focal point at the point between the first additional reflector and the corresponding second additional reflector, the light reflected from each the first reflectors can be once converged at the second focal point and thereafter caused to be incident on the second additional reflectors as light diverged from the second focal points. And by reflecting the incident light forward by the second additional reflectors, the forward projected light can be controlled accurately.

As described above, in accordance with one or more embodiments of the present invention, in the projector type of vehicle headlamp, the forward projected light can be controlled accurately and the light flux using rate of the light emitted from a light source can be enhanced.

In the above configuration, the second focal point of the ellipsoidal surface constituting the reflecting face of each the first additional reflectors may be located at a point in the vicinity of the reflecting face of the other first. reflector; and in a region in the vicinity of the second focal point of each the first additional reflectors, and each of light transmitting portions may be formed for transmitting the light from the light source reflected from the other first additional reflector. In accordance with such a configuration, the light transmitting portion for preventing the light reflected from each the first additional reflectors from being shielded by the other first additional reflector can be minimized in size. Thus, the light flux using rate of the light emitted from the light source can be further enhanced.

Now, the "point in the vicinity of the reflecting face" means any one of a point on the reflecting face, a point slightly apart from the reflecting face in the direction perpendicular thereto, a point slightly apart from the end of the face extended from the reflecting face, and a point slightly apart from the end of the face extended from the reflecting face and slightly apart from the reflecting face in the direction perpendicular thereto.

In this case, in the vicinity of each the light transmitting portions, each of shutters may be arranged for shielding the light from the light source which goes from each the first additional reflectors to each the second additional reflectors. By adopting such a configuration, each the additional distributed light patterns can be selectively added to the basic distributed light pattern. Therefore, a plurality of kinds of distributed light patterns can be formed using a single lamp unit.

In the above configuration, by forming the reflecting face of each of the second additional reflectors in an elliptical curved surface having a first focal point at the point in the vicinity of the second focal point of the ellipsoidal surface constituting the reflecting face of the first additional reflector corresponding to the second additional reflector, the light reflected by the second additional reflector can be once converged and thereafter projected forward. As a result, it is possible to prevent the light reflected by the second additional reflector from being inadvertently shielded by the other members of the lamp unit. Thus, the light flux using rate of the light emitted from the light source can be further enhanced.

The "elliptical curved surface" means a curved surface whose sectional shape is set as an elliptical shape in both vertical section and horizontal section, and in which the first focal point of an ellipsis constituting the vertical section is located at the point in the vicinity of the second focal point of the above ellipsoidal reflecting face of the first additional reflector. The elliptical curved surface is a concept including not only the ellipsoidal shape (ellipsoid of revolution) but also a curved surface which provides different eccentricities between the ellipsis constituting the vertical sectional shape and the ellipsis constituting the horizontal sectional shape.

In the above configuration, the vertical sectional shape in parallel to the optical axis of the reflecting face of each the second additional reflectors maybe formed as an elliptical shape which has a first focal point at the point in the vicinity of the second focal point of the ellipsoidal surface constituting the reflecting face of the first additional reflector corresponding to the second additional reflector; and a second focal point at the point located nearly flush with the lower edge of the reflecting face of the second additional reflector ahead of the first focal point by a predetermined distance. In accordance with such a configuration, the following advantage can be obtained.

Namely, by adopting such a configuration, the light from each the first additional reflectors incident on the region in the vicinity of the lower edge of the reflecting face of each the second additional reflectors is reflected in a direction in vertically nearly parallel to the optical axis and more downward at a point nearer to the upper edge. Thus, the road face ahead of one's own vehicle can be illuminated over the wide range from a short distance region to a long distant region.

In this case, the second focal point of each the second additional reflectors is located ahead of the first focal point thereof by a predetermined distance, but its concrete distance should not be particularly limited. If this distance is set at a longer distance, the vertical width of the distributed light pattern can be decreased, whereas if this distance is set at a shorter distance, the vertical width of each the additional distributed light patterns can be increased.

In the above configuration, each of convex lenses may be arranged ahead of each the second additional reflectors. In accordance with such a configuration, the light reflected from each the second additional reflectors can be controlled by each convex lens so that the additional distributed light pattern formed by the light projected forward through the first and second additional reflectors can be easily formed as a spot like distributed light pattern.

Incidentally, each the "convex lens" may be formed separately from the projection lens, or may be formed integrally to the projection lens.

In the above configuration, the pair of first additional reflectors and the pair of second additional reflectors may be arranged as two sets thereof in a nearly vertically symmetrical positional relationship with respect to the optical axis. In accordance with such a configuration, the greater part of the light not effectively used in the ordinary projector type of vehicle use can be effectively used as forward projected light. Thus, the light flux using rate of the light emitted from the light source can be further enhanced.

Other aspects and advantages of the invention will be apparent from the following description and the appended claims.

Figure 6A:
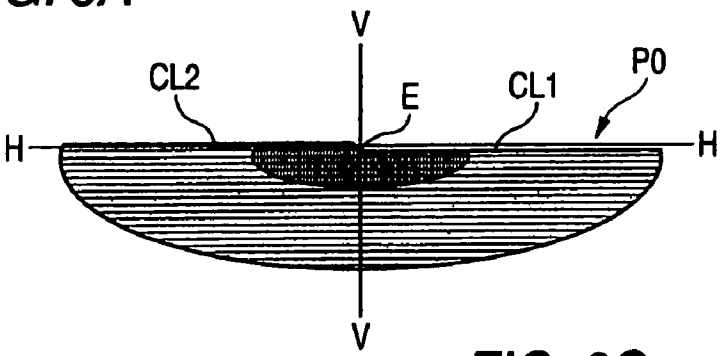

FIG. 6A is a view showing a basic distributed light pattern.

Figure 6B:
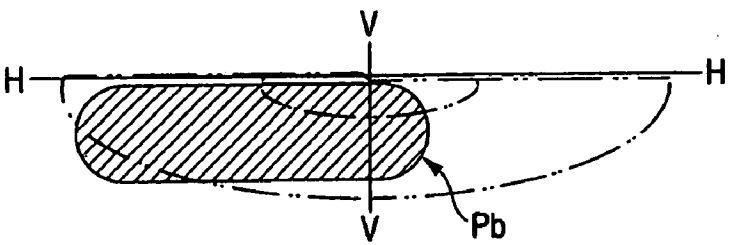

FIG. 6B shows an additional distributed light pattern Pb.

Figure 6C:
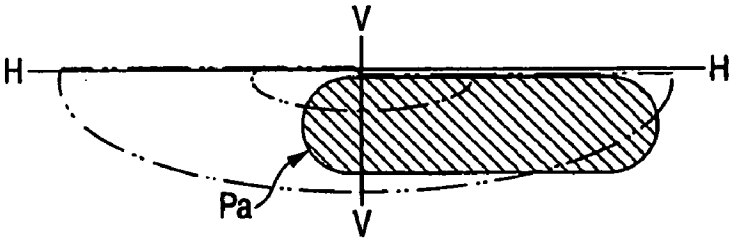

FIG. 6C shows an additional distributed light pattern Pa.

Figure 6D:
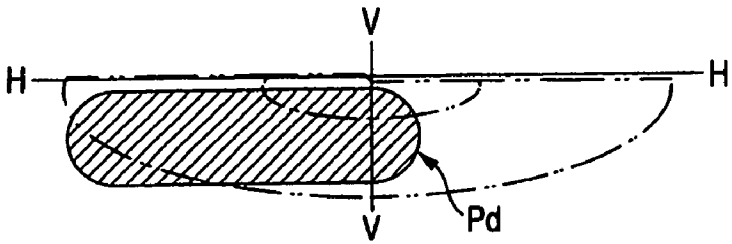

FIG. 6D shows an additional distributed light pattern Pd.

Figure 6E:
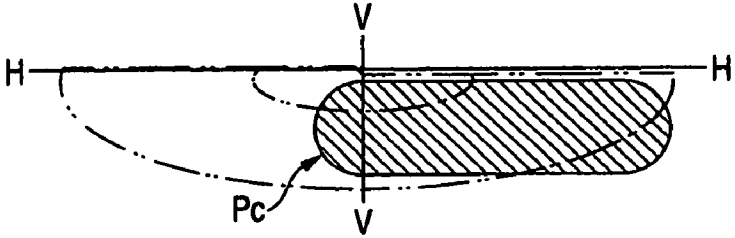

FIG. 6E shows an additional distributed light pattern Pc.

Figure 7:
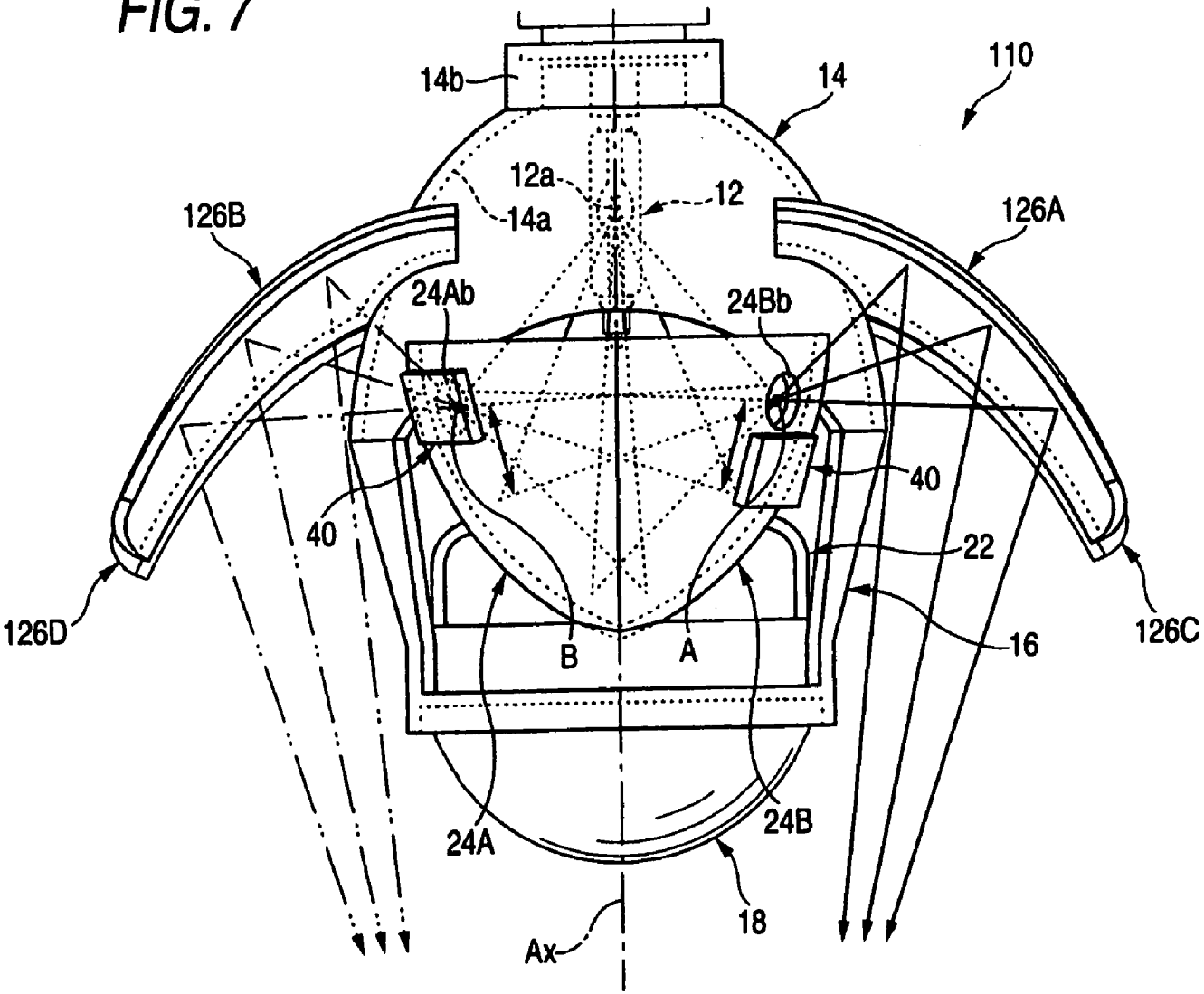

FIG. 7 is a plan view of a vehicle headlamp according to a second embodiment.

Figure 8:
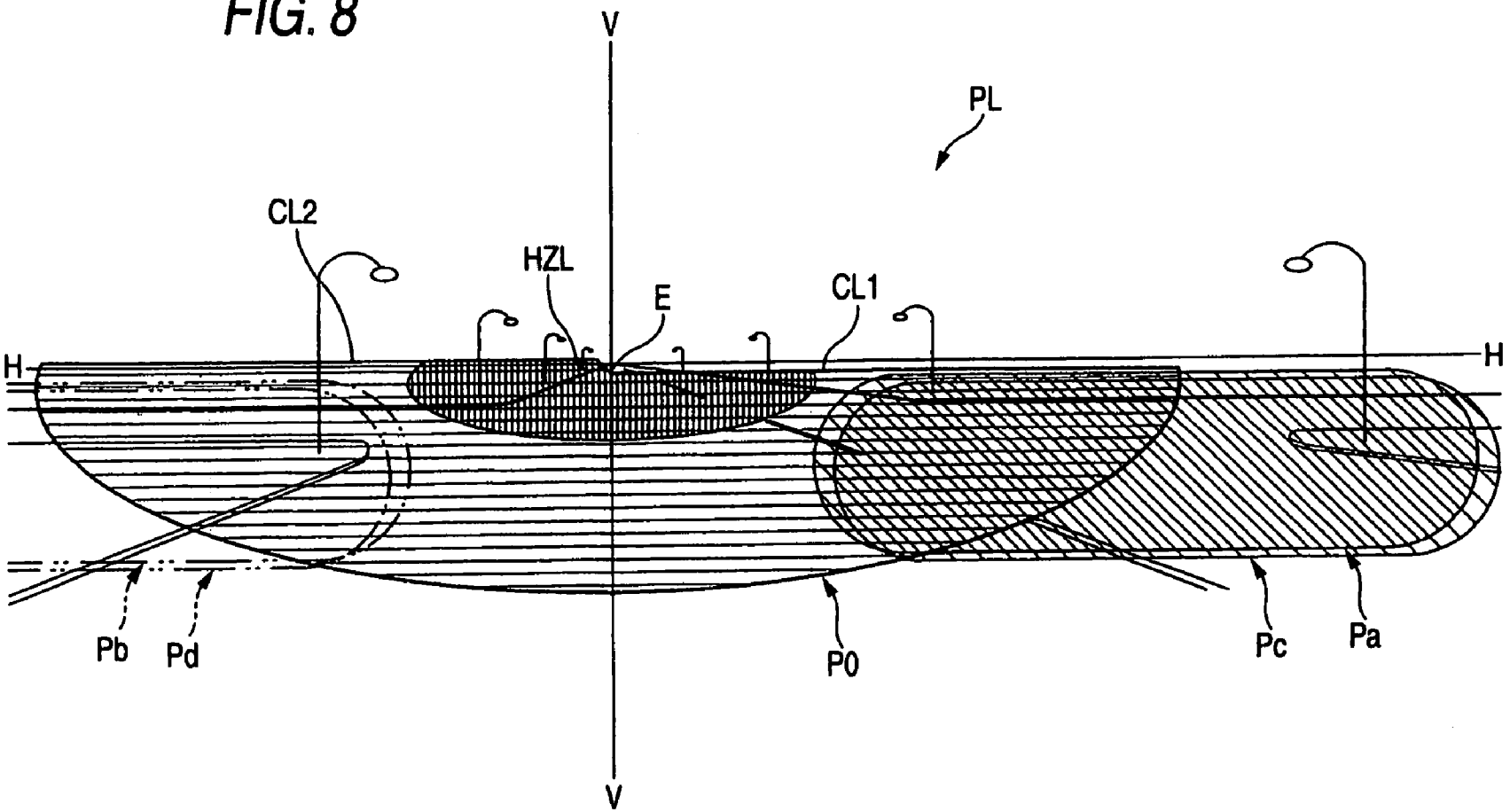

FIG. 8 is a perspective view of a distributed light pattern formed on the virtual vertical screen by the light projected forward from the vehicle headlamp according to the second embodiment.

Figure 9:
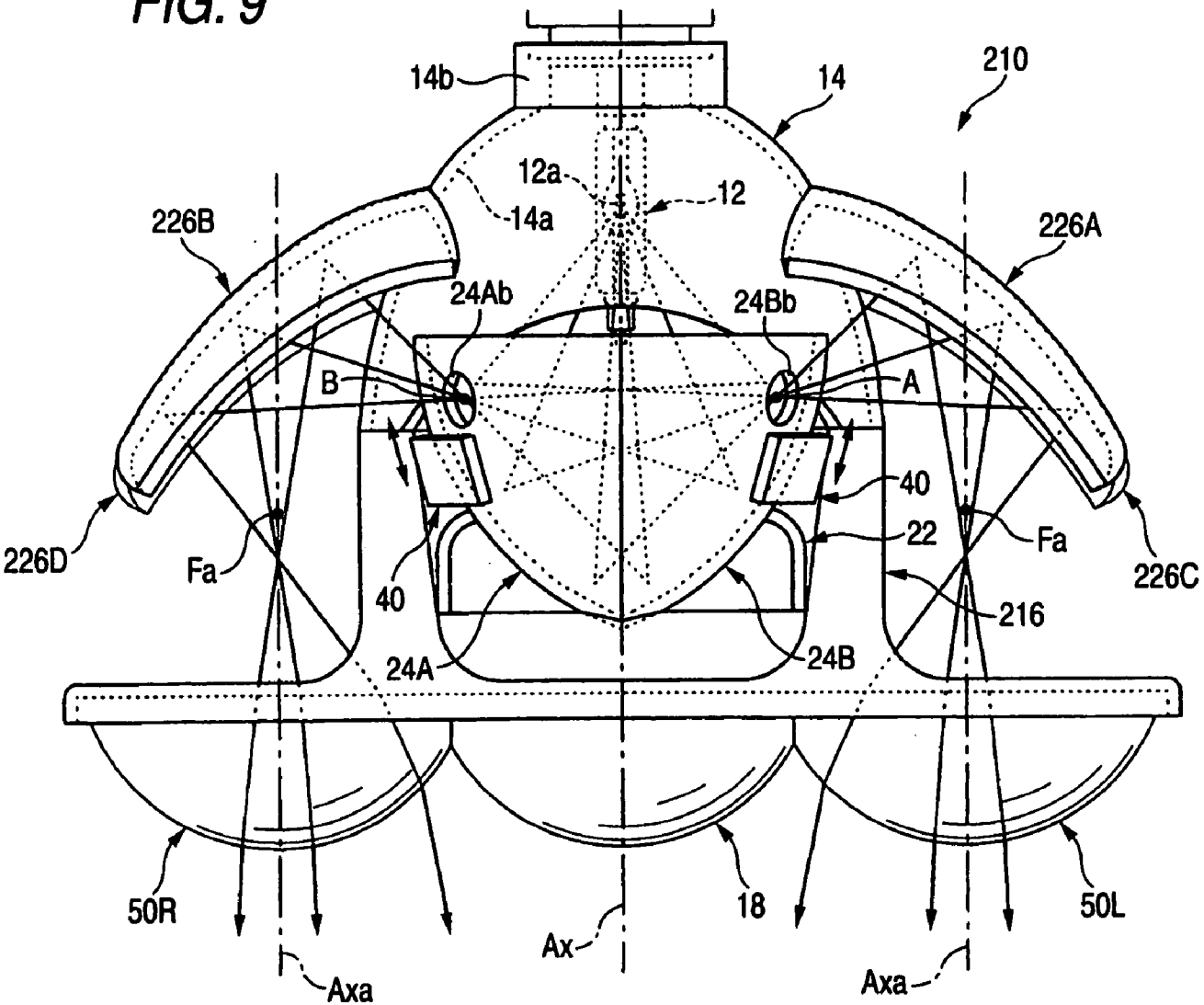

FIG. 9 is a plan view of a vehicle headlamp according to a third embodiment.

Figure 10:
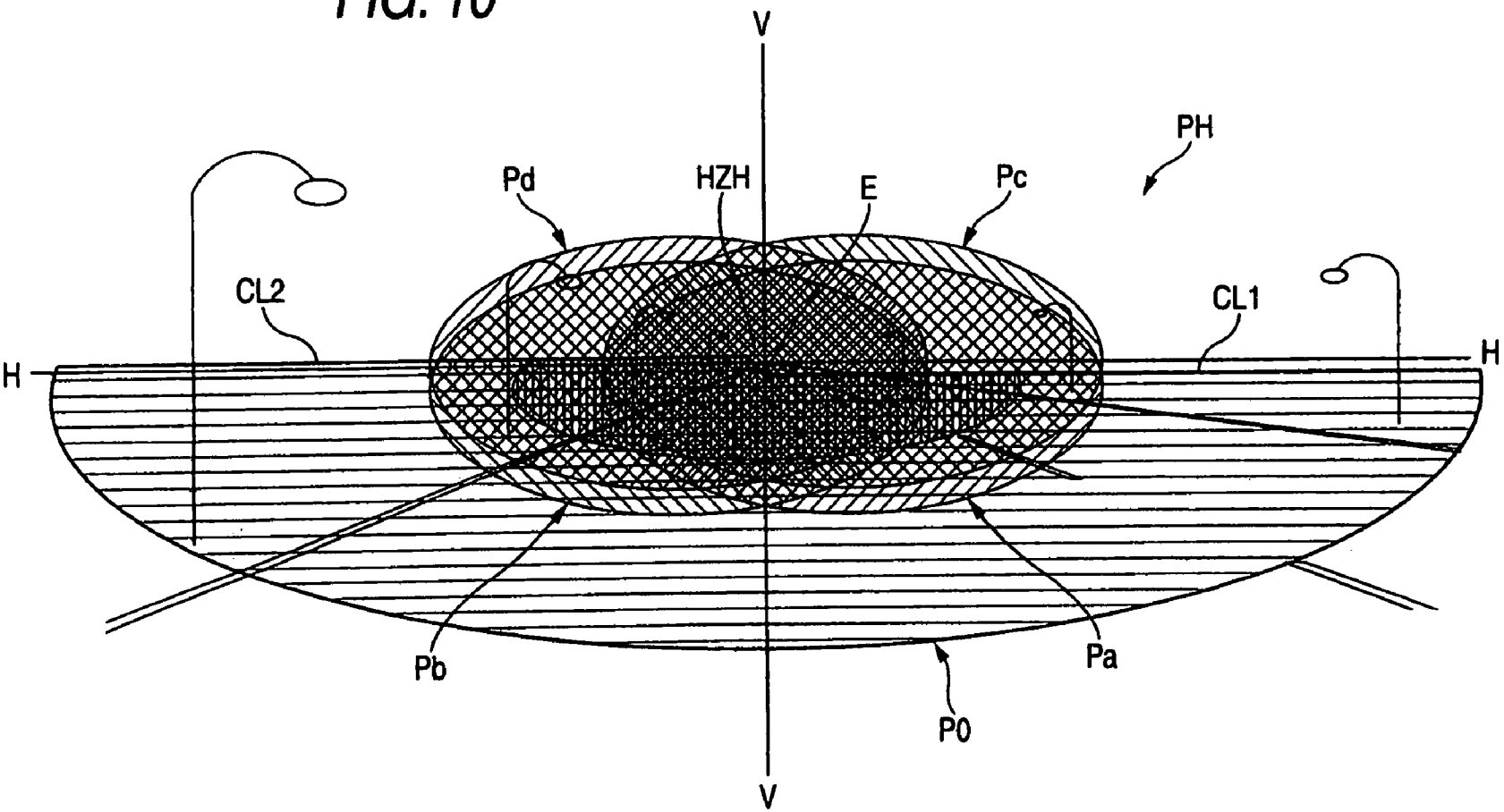

FIG. 10 is a perspective view of a distributed light pattern formed on the virtual vertical screen by the light projected forward from the vehicle headlamp according to the third embodiment.

Figure 11A:
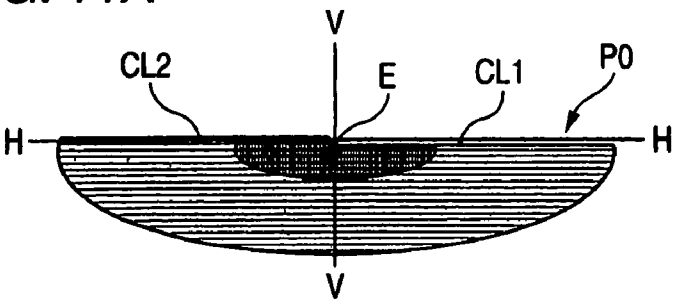

FIG. 11A is a view showing a basic distributed light pattern.

Figure 11B:
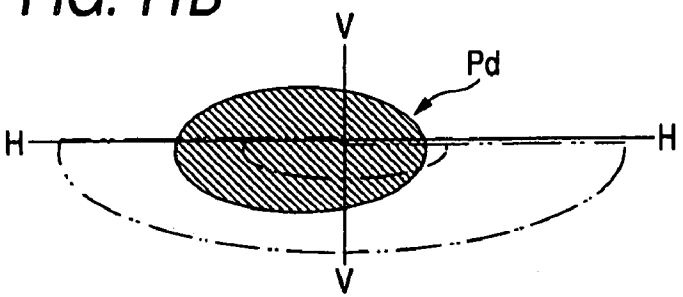

FIG. 11B shows an additional distributed light pattern Pd.

Figure 11C:
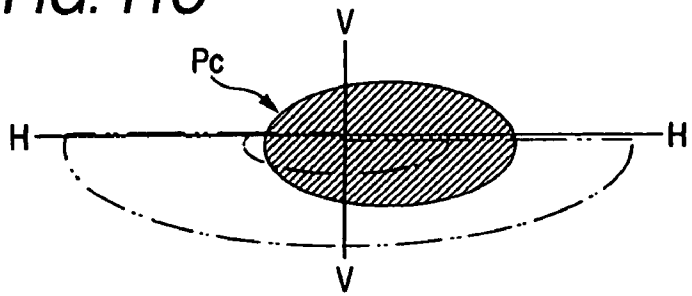

FIG. 11C shows an additional distributed light pattern Pc.

Figure 11D:
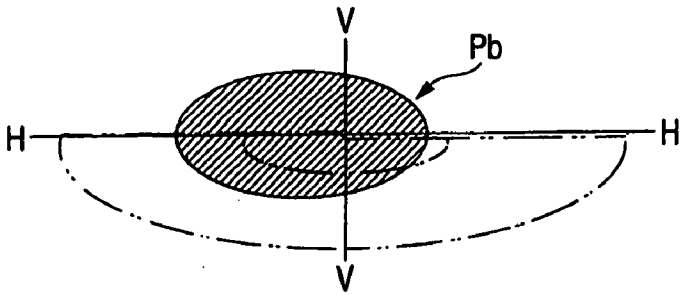

FIG. 11D shows an additional distributed light pattern Pb.

Figure 11E:
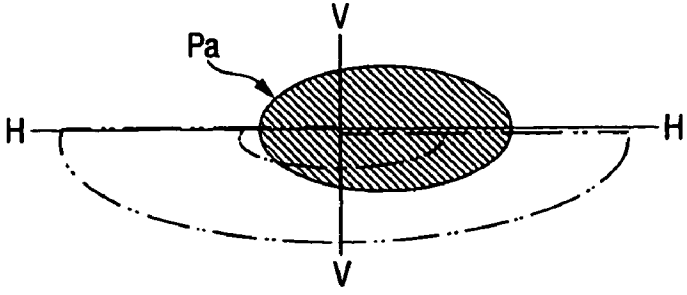

FIG. 11E shows an additional distributed light pattern Pa.

DESCRIPTION OF THE PREFERRED EMBODIMENTS

Embodiments of the invention will be described with reference to the accompanying drawings.

<First Embodiment>

Figure 1:
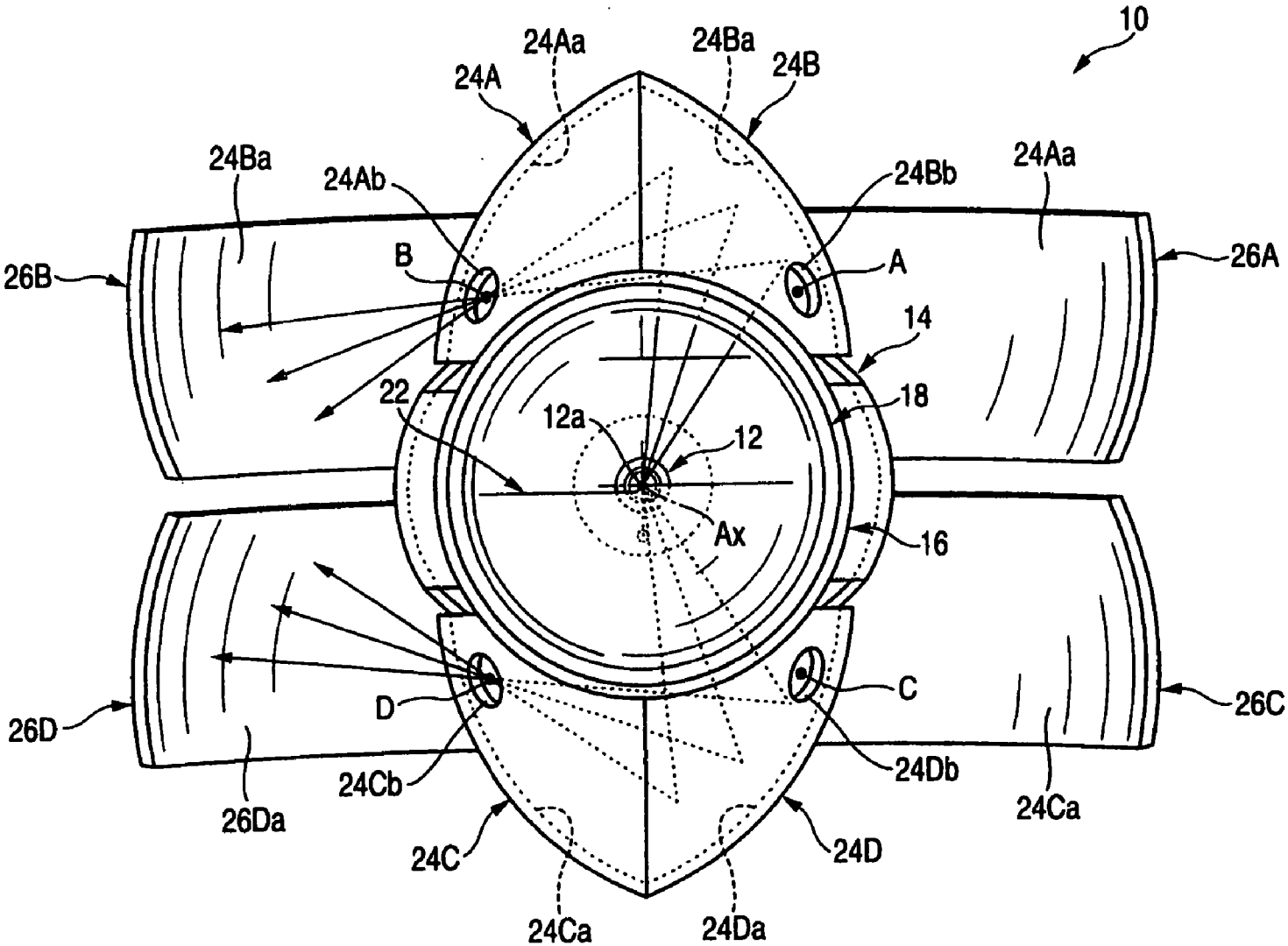
FIG. 1 is a front view of a vehicle headlamp according to a first embodiment
Figure 2:
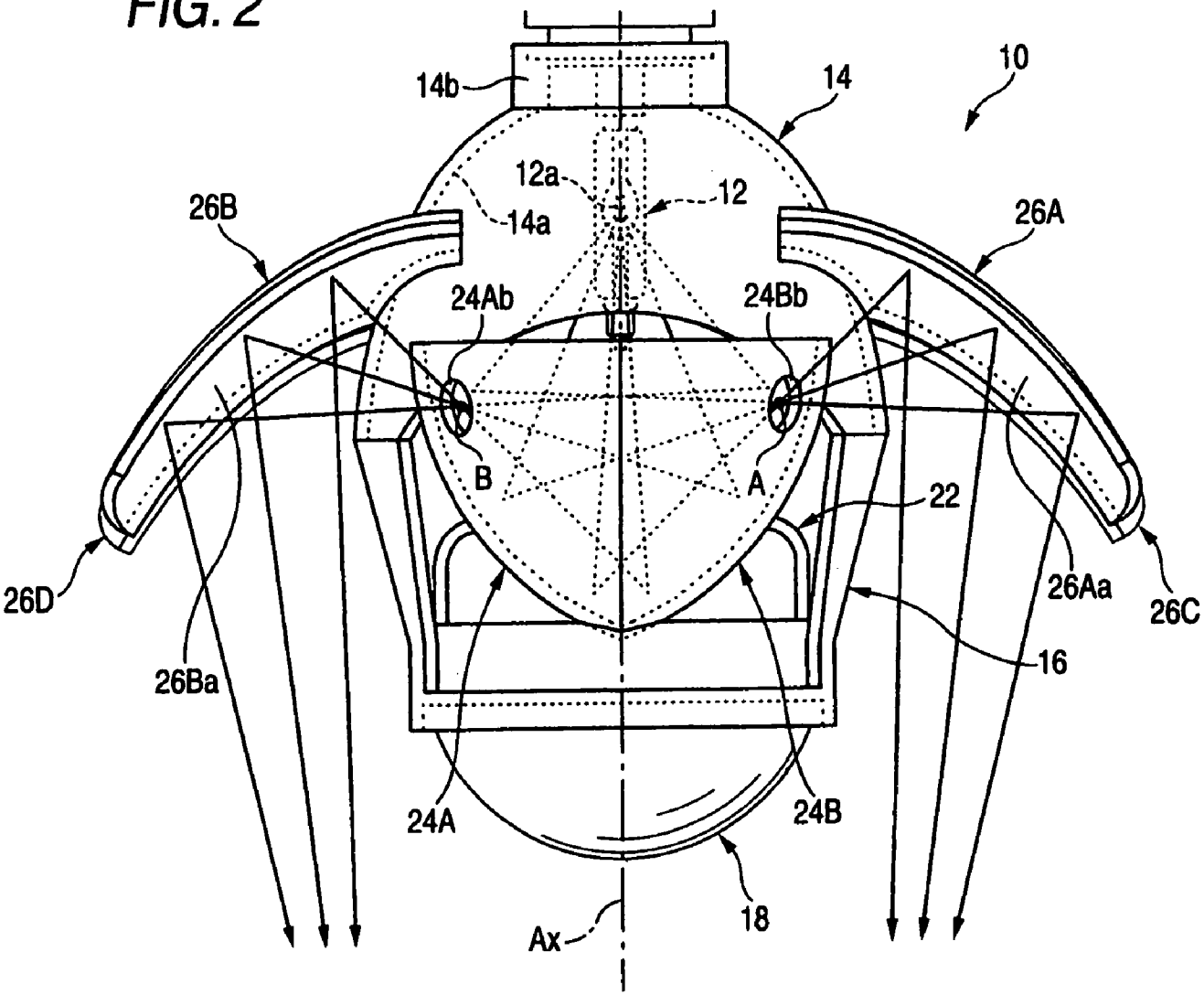
FIG. 2 is a plan view of the vehicle headlamp.
Figure 3:
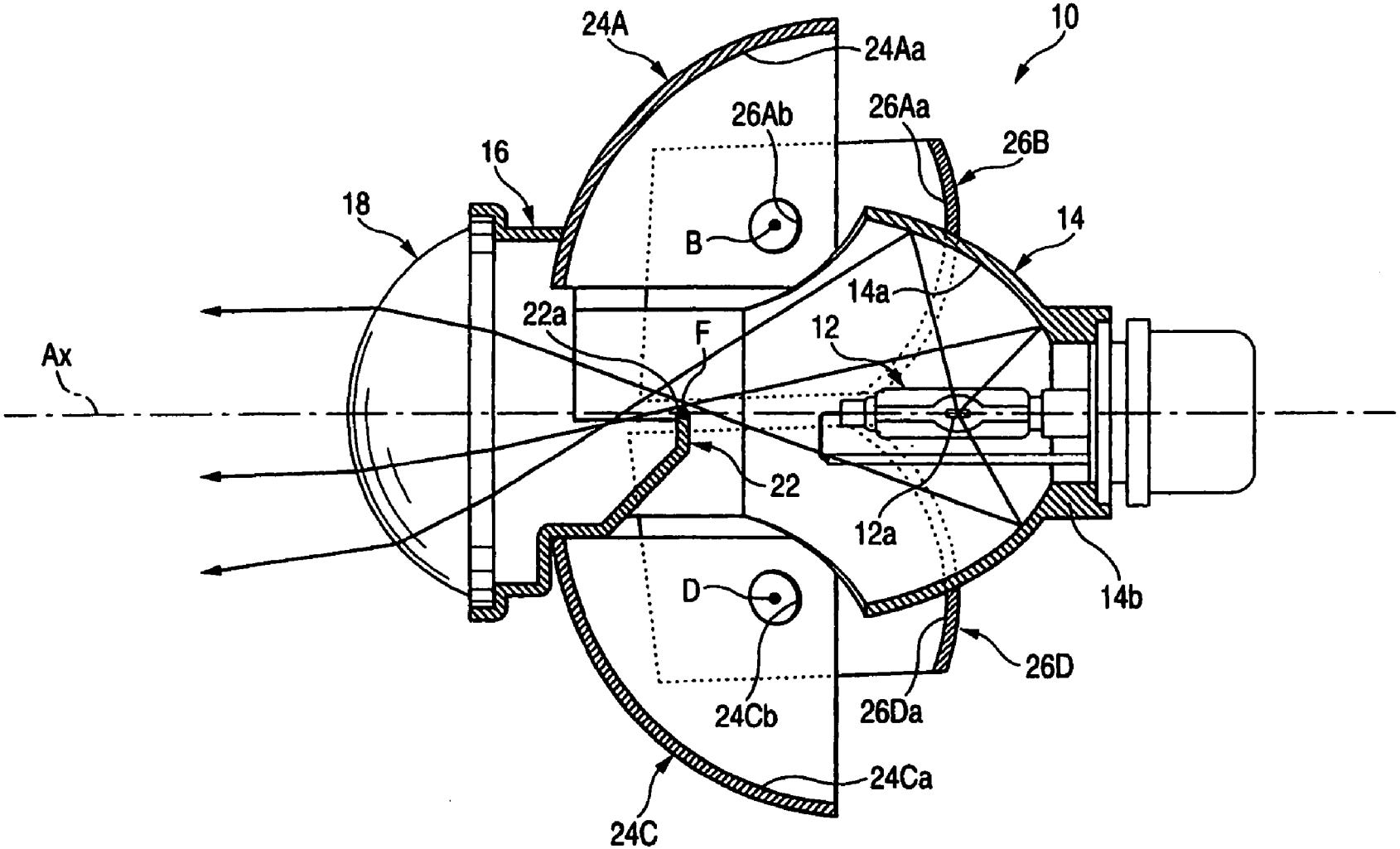
FIG. 3 is a side sectional view of the vehicle headlamp in which the light paths of light reflected by reflectors are shown.
Figure 4:
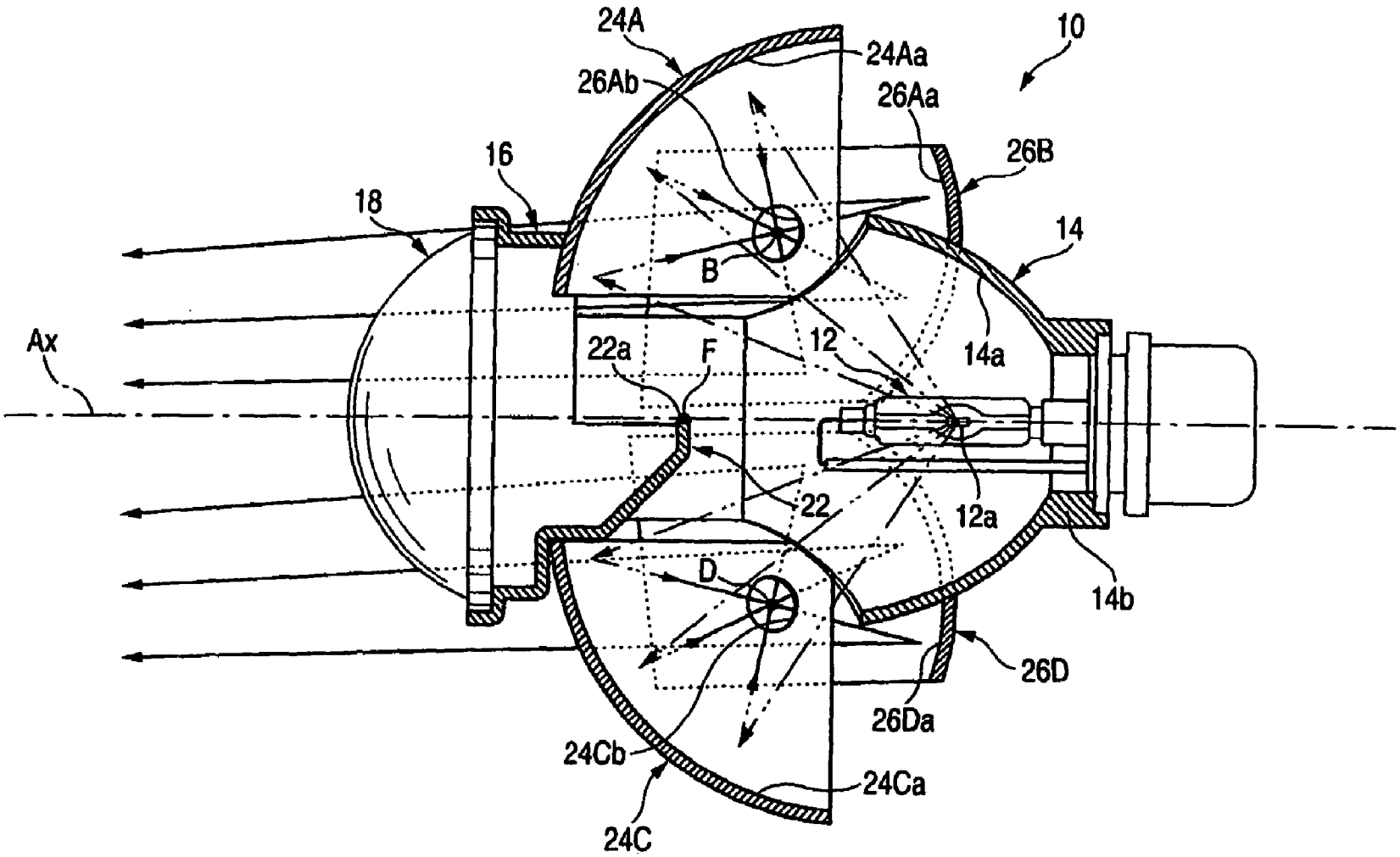
FIG. 4 is a side sectional view of the vehicle headlamp in which the light paths of light reflected by first and second additional reflectors are shown.

FIG. 1 is a front view of a vehicle headlamp according to a first embodiment; FIG. 2 is a plan view thereof; and FIGS. 3 and 4 are a side sectional view thereof, respectively.

As seen from the figures, a vehicle headlamp 10 is a projector type of vehicle headlamp having an optical axis Ax extending in the longitudinal direction of a vehicle in which when aiming adjustment has been completed, the optical axis Ax extends downward by about 0.5 to 0.6° in the longitudinal direction of the vehicle.

The vehicle headlamp 10 includes a light source bulb 12; a reflector 14; a holder 16; a projection lens 18; a shade 22; four first additional reflectors 24A, 24B, 24C, 24D; and four second additional reflectors 26A, 26B, 26C, 26D.

The projection lens 18 is a planoconvex lens with a convex face on the front side and a plane on the rear side, which is arranged on the optical axis Ax. The projection lens 18 serves to forward project the image on the focal plane including a rear focal point F as an inverted image.

The light source bulb 12 is a discharge bulb such as a metal halide bulb having a light source 12*a* as a discharge/light-emitting portion. The light source 12*a* is constructed as a segment light source extending along a bulb central axis. And the light source bulb 12 is fixedly inserted in an opening 14*b* formed at a rear apex of the reflector 14 so that the bulb central axis agrees with the optical axis Ax.

The reflector 14 has a reflecting face 14*a* which reflects the light emitted from the light source bulb 12 forward near the optical axis Ax. The reflecting face 14*a* is set so that. its sectional shape including the optical axis Ax is a nearly elliptical shape and its eccentricity gradually increases from a vertical section to a horizontal section. Thus, as seen from FIG. 3, the light from the light source 12*a* reflected by the reflecting face 14*a* is nearly converged in the vicinity of the rear focal point F in the vertical section and moved remarkably forward in the focusing point in the horizontal section.

The holder 16 is formed so as to extend in a nearly cylindrical shape forward from an opening at the front end of the reflector 14. The rear end of the holder 16 is fixedly supported by the reflector 14 whereas the front end thereof fixedly supports the projection lens 18.

The shade 22 is formed integrally to the holder 16 so that it is located at the nearly lower half part within an internal space of the holder 16. The shade 22 is formed so that its upper edge 22*a* passes the rear focal point F of the projection lens 18. Thus, the shade 22 shields a part of the light reflected from the reflecting face 14*a* of the reflector 14 so that the greater part of the upward light projected forward from the projection lens 18 is removed.

Of the four first additional reflectors 24A, 24B, 24C, 24D, two first additional reflectors 24A, 24B are located to be in contact with each other in a laterally symmetrical positional relationship at the upper position of the optical axis Ax between the reflector 14 and projection lens 18; and the remaining two first additional reflectors 24C, 24D are located to be in contact with each other in a laterally symmetrical positional relationship at the lower position of the optical axis Ax between the reflector 14 and projection lens 18.

Of the four second additional reflectors 26A, 26B, 26C, 26D, two second additional reflectors 26A, 26B are located on both left and right sides of the pair of first left and right additional reflectors 24A, 24B; and the remaining second additional reflectors 26C, 26D are located on both left and right sides of the pair of first left and right additional reflectors 24C, 24D.

Each the first additional reflectors 24A, 24B, 24C, 24D is designed to reflect the light emitted from the light source 12*a* toward the second additional reflectors 26A, 26B, 26C, 26D located on the opposite side to the first additional reflectors 24A, 24B, 24C, 24D with respect to the optical axis Ax. Each of the second additional reflectors 26A, 26B, 26C, 26D is designed to forward reflect the light from the light source 12*a* reflected by each the first additional reflectors 24A, 24B, 24C, 24D without being transmitted through the projection lens 18.

The reflecting face 24A*a*, 24B*a*, 24C*a*, 24D*a* of each of the first additional reflectors 24A, 24B, 24C, 24D is formed in a ellipsoidal shape (ellipsoid of revolution) which has a first focal point at the light emitting center of the light source 12*a* and a second focal point at the point A, B, C, D located between the first additional reflector 24A, 24B, 24C 24D and the corresponding second additional reflector 26A, 26B, 26C, 26D.

In this case, each the second focal points A, B, C, D is located on the reflecting face 24B*a*, 24A*a*, 24D*a*, 24C*a* of the other first reflector 24B, 24A, 24D, 24C (i.e. first reflector to form a pair with the first additional reflector 24A, 24B, 24C, 24D).

At the second focal point B, A, D, C of each the first reflectors 24A, 24B, 24C, 24D, each of light transmitting portions 24A*b*, 24B*b*, 24C*b*, 24D*b* is formed for transmitting the light from the light source 12*a* reflected from the other first additional reflector 24B, 24A, 24D, 24C.

Further, the reflecting face 26A*a*, 26B*a*, 26C*a*, 27D*a* of each of the second additional reflectors 26A, 26B, 26C, 26D is formed in an elliptical curved surface having a first focal point at each the second focal points A, B, C, D.

In this case, the vertical sectional shape in parallel to the optical axis Ax of the reflecting face 26A*a*, 26B*a*, 26C*a*, 26D*a* of each the second additional reflectors 26A, 26B, 26C, 26D is formed as an elliptical shape which has a first focal point at each the second focal points A, B, C, D and a second focal point at the point located nearly flush with the lower edge of the reflecting face 26A*a*, 26B*a*, 26C*a*, 26D*a* ahead of the first focal point A, B, C, D by a predetermined distance (Concretely, at the point located slightly downward as compared with the lower edge of each the reflecting face 26A*a*, 26B*a*, 26C*a*, 26D*a* ahead of each the first focal point A, B, C, D by a distance of about 20 to 30 cm). Thus, as seen from FIG. 4, the light from each the first additional reflectors 24A, 24B, 25C, 24D incident on the vicinity of the lower edge of the reflecting face 26A*a*, 26B*a*, 26C*a*, 26D*a* of each the second additional reflectors 26A, 26B, 26C, 26D is reflected in a direction in vertically nearly parallel to the optical axis Ax (concretely, in direction slightly downward from the optical axis Ax) and more downward at a point nearer to the upper edge.

On the other hand, the horizontal sectional shape of the reflecting face 26A*a*, 26B*a*, 26C*a*, 26D*a* of each the second additional reflectors 26A, 26B, 26C, 26D is set as an elliptical shape having a smaller eccentricity than the elliptical shape constituting the vertical sectional shape. Thus, as seen from FIG. 2, the light reflected from each the reflecting faces 26A*a*, 26B*a*, 26C*a*, 26D*a* is once converged within a horizontal plane and thereafter diffused relatively greatly.

Figure 5:
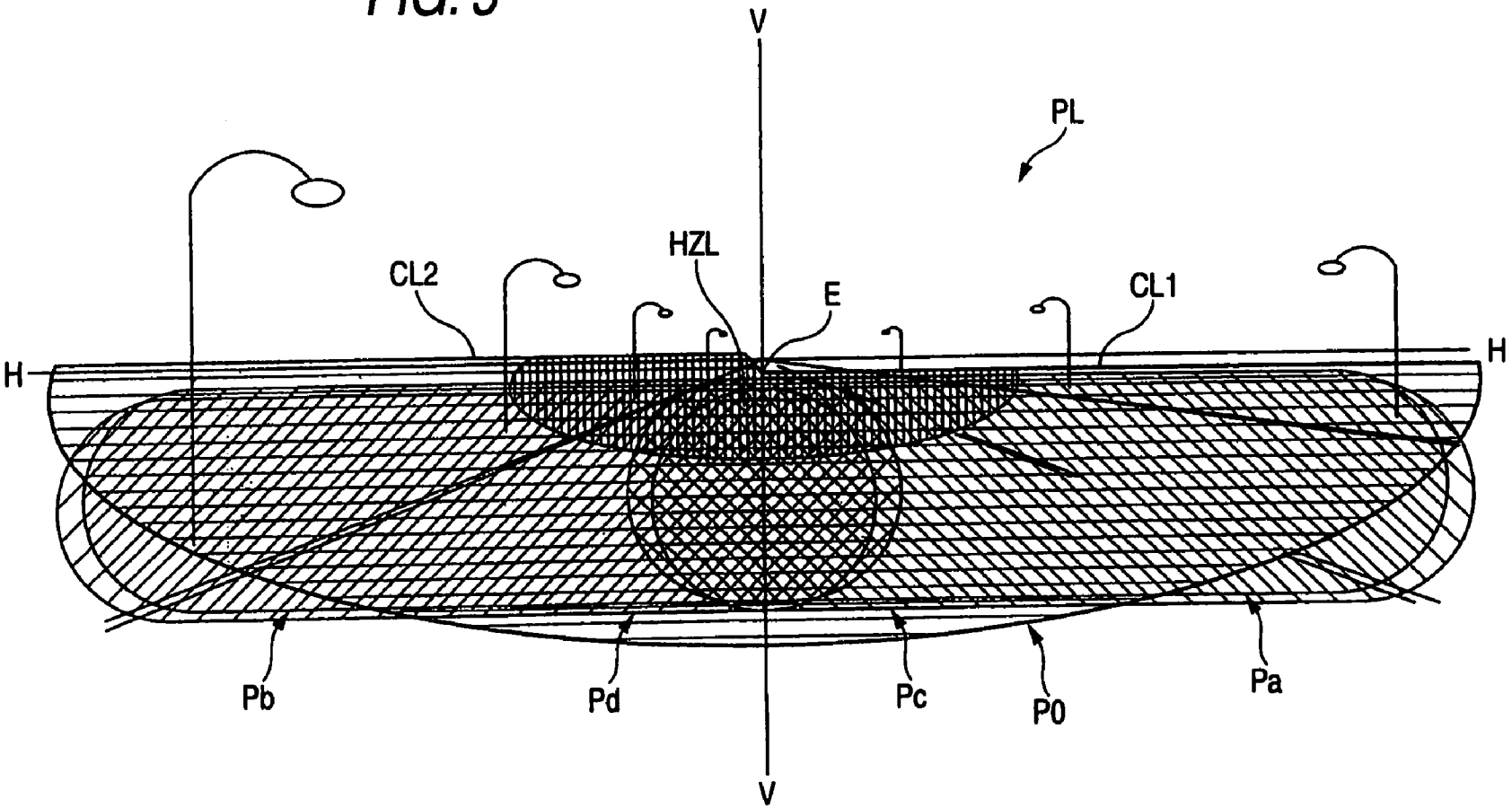
FIG. 5 is a perspective view of a distributed light pattern formed on a virtual vertical screen arranged at a position 25 m ahead of the lamp by light projected forward from the vehicle headlamp according to the first embodiment.

FIG. 5 is a perspective view of a distributed light pattern PL which is formed on a virtual vertical screen arranged at the position 25 m ahead of the lamp by the light projected forward from the vehicle headlamp 10 according to this embodiment.

As seen from FIG. 5, the distributed light pattern PL is a left distributed light pattern for a low beam which has cut off lines CL1, CL2 on left and right different levels on the upper edge. The cut off lines CL1, CL2 horizontally extend on the left and right different levels with respect to V—V line vertically passing H–V which is a vanishing point in the front side of the lamp. The portion of an opposite vehicle lane on the right side with respect to the line V—V is formed as a lower cut-off line CL1 whereas the portion of one's own vehicle lane on the left side with respect to the line V—V is formed as an upper cut-off line CL2 which steps up through a slope from the lower cut-off line CL1.

In the distributed light pattern PL for the low beam, an elbow point E which is an intersection point of the lower cut-off line CL1 and line V—V is located downward by about 0.5 to 0.6° of H–V. This is because the optical axis Ax extends downward by 0.5 to 0.6° from the longitudinal direction of the vehicle. And in the distributed light pattern PL for the low beam, a hot zone HZL which is a high luminous intensity zone is formed so as to surround the elbow point E.

The distributed light pattern PL for the low beam is formed as a composed distributed light pattern consisting of a basic distributed light pattern P0 and four additional distributed light patterns Pa, Pb, Pc, Pd.

FIGS. 6A to 6E are views showing the basic distributed light pattern P0 and the four additional distributed light patterns Pa, Pb, Pc, Pd decomposed from the distributed light pattern PL for the low beam.

As seen from FIG. 6A, the basic distributed light pattern P0 is a distributed light pattern which constitutes a basic shape of the distributed light pattern PL for the low beam. The basic distributed light pattern P0 is formed by projecting the image of the light source 12*a*, which is formed on the rear focal plane of the projection lens 18 by the light from the light source 12*a* reflected by the reflector 14, onto the above virtual vertical screen as an inverted projected image by the projection lens 18. The cut-off lines CL1, CL2 are formed in the inverted projected image of the upper edge 22*a* of the shade 32.

On the other hand, the additional distributed pattern Pa, Pb, Pc, Pd is a distributed light pattern additively formed to reinforce the brightness of the basis distributed light pattern PO, which is formed by the light reflected by each of the second additional reflectors 26A, 26B, 26C, 26D.

In this case, since the reflecting face 26A*a*, 26B*a*, 26C*a*, 26D*a* of each the second additional reflectors 26A, 26B, 26C, 26D is formed as an elliptical curved surface, the distributed light pattern Pa, Pb, Pc, Pd is a distributed light pattern having an expanse to a certain degree in a vertical direction and a lateral direction. In addition, since the ellipsis constituting a horizontal section has a larger eccentricity, the expanse is larger in the lateral direction. And the additional distributed light pattern Pa, Pc formed by the reflected light from the second additional reflector 26A, 26C located on the left side of the optical axis Ax is a distributed light pattern expanding from the central region of the basic distributed light pattern PO to its right edge region; and the additional distributed light pattern Pb, Pd formed by the reflected light from the second additional reflector 26B, 26D located on the right side of the optical axis Ax is a distributed light pattern expanding from the central region of the basic distributed light pattern P0 to its left edge region.

The upper edge of each the additional distributed light patterns Pa, Pb, Pc, Pd is located nearly flush with the lower cut-off line CL1. This is because the second focal point of the ellipsis constituting the vertical sectional shape of each the second additional reflectors 26A, 26B, 26C, 26D is located nearly flush with the lower edge of the reflecting face 26A*a*, 26B*a*, 26C*a*, 26D*a*.

As understood from the detailed description hitherto made, the vehicle headlamp 10 according to this embodiment is constituted as a projector type of vehicle headlamp for performing light projection for forming a distributed light pattern PL for a low beam. In this vehicle headlamp, at the upper position of the optical axis Ax between the reflector 14 and projection lens 18, a pair of left and right first additional reflectors 24A, 24B are arranged and a pair of second additional reflectors 26A, 26B are arranged on both the left and right sides of the pair of first additional reflectors 24A, 24B; each the first additional reflectors 24A, 24B is designed to reflect the light from the light source 12*a* toward the second additional reflector 26A, 26B located on the side opposite to the first additional reflector 24A, 24B with respect to the optical axis Ax; and each the second additional reflectors 26A, 26B is designed to forward reflect the light from the light source 12*a* reflected from each the first additional reflectors 24A, 24B without being transmitted through the projection lens 18. Further, at the lower position of the optical axis Ax between the reflector 14 and projection lens 18, a pair of left and right first additional reflectors 24C, 24D are arranged and a pair of second additional reflectors 26C, 26D on both the left and right sides of the pair of first additional reflectors 24C, 24D; each the first additional reflectors 24C, 24D is designed to reflect the light from the light source 12*a* toward the second additional reflector 26C, 26D located on the side opposite to the first additional reflector 24C, 24D with respect to the optical axis Ax; and each the second additional reflectors 26C, 26D is designed to forward reflect the light from the light source 12*a* reflected from each the first additional reflectors 24C, 24D without being transmitted through the projection lens 18. In accordance with such a configuration, the greater part of the light not effectively used in the ordinary projector type of vehicle use can be effectively used as forward projected light.

In this way, the distributed light pattern PL for a low beam formed by the light projected from the vehicle headlamp 10 can be formed as a composed distributed light pattern consisting of the basic distributed light pattern P0 formed by the light forward projected through the reflector 14 and projection lens 18, the pair of additional distributed light patterns Pa, Pb formed by the light forward projected through the pair of first additional reflectors 24A, 24B and pair of second additional reflectors 26A, 26B and the pair of additional distributed light patterns Pc, Pd formed by the light forward projected through the pair of first additional reflectors 24C, 24D and pair of second additional reflectors 26C, 26D.

In this case, the reflecting face 24A*a*, 24B*a*, 24C*a*, 24D*a* of each the first additional reflectors 24A, 24B, 24C, 24D is formed in a ellipsoidal shape which has a first focal point at the point in the vicinity of the light source 12*a* and a second focal point at the point A, B, C, D located between the first additional reflector 24A, 24B, 24C, 24D and the corresponding second additional reflector 26A, 26B, 26C, 26D. In accordance with such a configuration, the light reflected from each the first additional reflectors 24A, 24B, 24C, 24D can be converged at the second focal point A, B, C, D and thereafter caused to be incident on the second additional reflector as the light diverged from the second focal point A, B, C, D. And by reflecting this incident light forward of the lamp unit by the second additional reflector 26A, 26B, 26C, 26D, the forward projected light can be controlled accurately.

As understood from the above description, in accordance with the embodiment, in the projector type of vehicle headlamp 10, the forward projected light can be controlled accurately and also the light flux using rate of the light emitted from the light source 12*a* can be enhanced.

Particularly, in the embodiment, the pair of first additional reflectors 24A, 24B and the pair of second additional reflectors 26A, 26B; and the pair of first additional reflectors 24C, 24D and the pair of second additional reflectors 26C, 26D are arranged as two sets thereof in a nearly vertically symmetrical positional relationship with respect to the optical axis Ax. As a result, the greater part of the light not effectively used in the ordinary projector type of vehicle use can be effectively used as forward projected light. Thus, the light flux using rate of the light emitted from the light source 12*a* can be further enhanced.

In this case, in the embodiment, the second focal point A, B, C, D of the ellipsoidal surface constituting the reflecting face 24A*a*, 24B*a*, 24C*a*, 24D*a* of each the first additional reflectors 24A, 24B, 24C, 24D is located at the point in the vicinity of the reflecting face 24B*a*, 24A*a*, 24D*a*, 24C*a* of the other first reflector 24B, 24A, 24D, 24C. In addition, in the region in the vicinity of the second focal point A, B, C, D of the other first additional 24A, 24B, 24C, 24D, the light transmitting portion 24A*b*, 24B*b*, 24C*b*, 24D*b* is formed for transmitting the light from the light source 12*a* reflected from the other first additional reflector 24B, 24A, 24D, 24C. In accordance with such a configuration, the light transmitting portion for preventing the light reflected from each the first additional reflectors 24A, 24B, 24C, 24D from being shielded by the other first additional reflector 24B, 24A, 24D, 24C can be minimized in size. Thus, the light flux using rate of the light emitted from the light source 12*a* can be further enhanced.

In this embodiment, since the reflecting face 26A*a*, 26B*a*, 26C*a*, 26D*a* of each the second additional reflectors 26A, 26B, 26C, 26D is formed as an elliptical curved surface having the first focal point at the above second focal point A, B, C, D, the light reflected by the second additional reflector 26A, 26B, 26C, 26D can be once converged and thereafter projected forward. For this reason, it is possible to prevent the light reflected by each the second additional reflectors 26A, 26B, 26C, 26D from being inadvertently shielded by the other members of the lamp unit. Thus, the light flux using rate of the light emitted from the light source 12*a* can be further enhanced. Incidentally, the horizontal sectional shape of the reflecting face 26A*a*, 26B*a*, 26C*a*, 26D*a* of each the second additional reflectors 26A, 26B, 26C, 26D may be set as a curve (e.g. a parabola, ahyperbola, free curve, etc.) other than the ellipse.

Further, in the embodiment, the vertical sectional shape in parallel to the optical axis Ax of the reflecting face 26A*a*, 26B*a*, 26C*a*, 26D*a* of each the second additional reflectors 26A, 26B, 26C, 26D is formed as an elliptical shape which has a first focal point at the second focal points A, B, C, D and a second focal point at the point located linearly flush with the lower edge of the reflecting face 26A*a*, 26B*a*, 26C*a*, 26D*a* ahead by a predetermined distance of the second focal point. Thus, the light from each the first additional reflectors 24A, 24B, 25C, 24D incident on the region in the vicinity of the lower edge of the reflecting face 26A*a*, 26B*a*, 26C*a*, 26D*a* of each the second additional reflectors 26A, 26B, 26C, 26D can be reflected in a direction in vertically nearly parallel to the optical axis Ax, and more downward at a point nearer to the upper edge. As a result, the road face ahead of one's own vehicle can be illuminated over the wide range from a short distance region to a long distant region.

Incidentally, in the embodiment, the pair of first additional reflectors 24A, 24B and the pair of second additional reflectors 26A, 26B; and the pair of first additional reflectors 24C, 24D and the pair of second additional reflectors 26C, 26D were arranged as two sets thereof in a nearly vertically symmetrical positional relationship with respect to the optical axis Ax. However, they may be arranged as only one set thereof.

<Second Embodiment>

FIG. 7 is a plan view of a vehicle headlamp 110 according to a second embodiment.

As seen from the figure, the basic structure of the vehicle headlamp 110 is the same as that of the vehicle headlamp 10 according to the first embodiment, but is different in the following matters.

Specifically, each of second additional reflectors 126A, 126B, 126C, 126D reflects the light from each the first additional reflectors 24A, 24B, 24C, 24D in a direction nearer to the optical axis Ax than the each of second additional reflectors 26A, 26B, 26C, 26D according to the first embodiment does.

Further, in the embodiment, in the vicinity of each the light transmitting portions 24A*b*, 24B*b*, 24C*b*, 24D*b*, each of shutters 40 is arranged for shielding the light from the light source 12*a* which goes from each the first additional reflectors 24A, 24B, 24C, 24D to each the second additional reflectors 126A, 126B, 126C, 126D.

Each shutter 40 is adapted to make a reciprocating motion in an arrow direction individually by a driving mechanism (not shown). Thus, the shutter 40 can be set at the light shielding position where the light incidence on each the second additional reflectors 126A, 126B, 126C, 126D is blocked and at a light shield releasing position.

FIG. 8 is a perspective view of a distributed light pattern PL which is formed on a virtual vertical screen arranged at the position 25 m ahead of the lamp by the light projected forward from the vehicle headlamp 110 according to this embodiment.

As seen from FIG. 8, the basic distributed light pattern PO is entirely the same as in the first embodiment, and each the additional distributed light patterns Pa, Pb, Pc, Pd is also the same as in the first embodiment in their pattern shape.

However, in the embodiment, the additional distributed light pattern Pa, Pc formed by the light reflected from each the second additional reflectors 126A, 126C located on the left side of the optical axis Ax is formed to expand further rightward from the region in the vicinity of the right edge of the basic distributed light pattern PO; and the additional distributed light pattern Pb, Pd formed by the light reflected from each the second additional reflectors 126B, 126D located on the left side of the optical axis Ax is formed to expand further leftward from the region in the vicinity of the left edge of the basic distributed light pattern PO.

By adopting the structure according to this embodiment, each the additional distributed light patterns Pa, Pb, Pc, Pd can be selectively added to the basic distributed light pattern PO. Therefore, as the distributed light pattern for the low beam, a plurality of kinds of distributed light patterns can be formed using a single lamp unit.

For example, in a status where the vehicle runs straight, each the shutters 40 is closed to perform the light projection for making the basic distributed light pattern PO. When the vehicle turns right, the shutter 40 for the second additional reflector 126A, 126C located on the left side is opened as indicated in solid line in FIG. 8 to additively form the additional distributed light pattern Pa, Pc. In this way, the road face ahead of the vehicle, located ahead in the turning direction can be illuminated brightly. When the, vehicle turns left, the shutter 40 for the second additional reflector 126B, 126D located on the right side is opened as indicated in two dot chain line in FIG. 8 to additively form the additional distributed light pattern Pb, Pd. In this way, the road face ahead of the vehicle, located ahead in the turning direction can be illuminated brightly.

Incidentally, in the vicinity of each the light transmitting portions 24A*b*, 24B*b*, 24C*b*, 24D*b*, in place of each the shutters 40 in this embodiment, each of fixed shades may be arranged for shielding a part of the light from the light source which goes from each the first additional reflectors 24A, 24B, 24C, 24D to each the second additional reflectors 126A, 126B, 126C, 126D. By adopting such a configuration, each the additional distributed light patterns Pa, Pb, Pc, Pd can be formed as a distributed light pattern having the upper edge of a cut-off line which is an inverted image of the upper edge of the fixed shade. In this case, from the standpoint of view of making the cut-off line clear, the second focal point of the ellipsoidal surface constituting the reflecting face 24A*a*, 24B*a*, 24C*a*, 24D*a* of each the first additional reflectors 24A, 24B, 24C, 24D is preferably positioned at the upper edge of the fixed shade arranged for the light transmitting portion 24B*b*, 24A*b*, 24D*b*, 24C*b* making pairs with the first additional reflector 24A, 24B, 24C, 24D.

<Third Embodiment>

FIG. 9 is a plan view of a vehicle headlamp 210 according to a third embodiment.

As seen from the figure, the basic structure of the vehicle headlamp 210 is the same as that of the vehicle used headlamp 100 according to the first embodiment, but is different in the following matters.

In this embodiment, on both left and right sides of the projection lens 18, a pair of convex lenses 50L, 50R are arranged. Like the projection lens 18, each the convex lenses 50L, 50R is a planoconvex lens with a convex face on the front side and a plane on the rear side, which is arranged the axis line Axa parallel to on the optical axis Ax. Each the convex lenses 50L, 50R is formed integrally to the projection lens 18. A holder 216 fixedly supports the pair of convex lenses 50L, 50R as well as the projection lens 18.

In the embodiment, each of second additional reflectors 226A, 226C located on the left side of the optical axis Ax has a reflecting face having a larger curvature than that of each the second additional reflectors 26A, 26C according to the first embodiment. Each the second additional reflectors 226A, 226C serves to reflect the light from the light source 12*a* reflected by each the first reflectors 24A, 24C so that it is nearly converged at a position slightly ahead of the rear focal point Fa of the convex lens 50L located on the left side of the projection lens 18, and thereafter cause the reflected light to be incident on the convex lens 50L. Thus the light emitted from the convex lens 50L is caused to become like parallel light.

Likewise, each of second additional reflectors 226B, 226D located on the right side of the optical axis Ax has a reflecting face having a larger curvature than that of each the second additional reflectors 26B, 26D according to the first embodiment. Each the second additional reflectors 226B, 226D serves to reflect the light from the light source 12*a* reflected by each the first reflectors 24A, 24C so that it is nearly converged at a position slightly ahead of the rear focal point Fa of the convex lens 50R located on the right side of the projection lens 18, and thereafter cause the reflected light to be incident on the convex lens 50R. Thus, the light emitted from the convex lens 50R is caused to become like parallel light.

Further, in the embodiment, like the second embodiment, each of shutters 40 is arranged in the vicinity of each the light transmitting portions 24A*b*, 24B*b*, 24C*b*, 24D*b*.

FIG. 10 is a perspective view of a distributed light pattern PL which is formed on a virtual vertical screen arranged at the position 25 m ahead of the lamp by the light projected forward from the vehicle headlamp 210 according to this embodiment. FIGS. 11A to 11E are views showing the basic distributed light pattern P0 and the four additional distributed light patterns Pa, Pb, Pc, Pd decomposed from the distributed light pattern.

As seen from these figures, the basic distributed pattern P0 is entirely the same as that in the first embodiment.

On the other hand, each the additional distributed light patterns Pa, Pb, Pc, Pd is formed around the elbow point E as a partly spot like distributed light pattern having a smaller left and right diffusion angle than in the second embodiment. And these additional distributed light patterns Pa, Pb, Pc, Pd are composed to form a hot zone HZH in the vicinity of the elbow point E.

In this embodiment, the basic distributed light pattern PO constitutes the distributed light pattern for the low beam. The additional distributed light patterns Pa, Pb, Pc, Pd are added to the basic distributed light pattern P0, thereby providing the distributed light pattern PH for a high beam as shown in FIG. 10.

The beam switching between the low beam and high beam is carried out by simultaneously opening/closing the shutters 40.

By adopting the structure according to the embodiment, the distributed light pattern for the low beam and the distributed light pattern for the high beam can be selectively formed by a single vehicle headlamp 210.

Incidentally, in the embodiment, the light reflected from the two second additional reflectors 226A, 226C located on the left side is caused to be incident on the same convex lens 50L and the light reflected from the two additional reflectors 226B, 226D located on the right side is caused to be incident on the same convex lens 50R. However, the convex lens may be arranged ahead of each the second additional reflectors 226A, 226B, 226C, 226D.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

a projection lens arranged on an optical axis extending in the longitudinal direction of a vehicle;

a light source arranged behind a rear focal point of the projection lens;

a reflector for reflecting light emitted from the light source toward the optical axis;

a pair of left and right first additional reflectors arranged at an upper position or lower position of the optical axis between the reflector and projection lens; and a pair of left and right second additional reflectors, wherein the left second additional reflector is arranged on a left side of the left first additional reflector, and the right second additional reflector is arranged on a right side of the right first additional reflector, wherein the left first additional reflector reflects the light from the light source toward the right second additional reflector, and the right first additional reflector reflects the light from the light source toward the left second additional reflector, the second additional reflectors forward reflect the light from the first additional reflectors without being transmitted through the projection lens, and the left first additional reflector has a reflecting face formed in a ellipsoidal shape with a first focal point in the vicinity of the light source and a second focal point between the left first additional reflector and the right second additional reflector, and the right first additional reflector has a reflecting face formed in a ellipsoidal shape with a first focal point in the vicinity of the light source and a second focal point between the right first additional reflector and the left second additional reflector.

2. The vehicle headlamp according to claim 1, wherein the second focal point of the reflecting face of the left first additional reflector is located in the vicinity of the reflecting face of the right first reflector, and the second focal point of the reflecting face of the right first additional reflector is located in the vicinity of the reflecting face of the left first reflector, the left first additional reflector has a light transmitting portion, for transmitting the light reflected on the right first additional reflector, in the vicinity of the second focal point of the reflecting face of the left first additional reflector, and the right first additional reflector has a light transmitting portion, for transmitting the light reflected on the left first additional reflector, in the vicinity of the second focal point of the reflecting face of the right first additional reflector.

3. The vehicle headlamp according to claim 1, further comprising:

shutters provided in the vicinity of the respective light transmitting portions, wherein the shutter on the light transmitting portion of the left first additional reflector shields the light from the right first additional reflector to the left second additional reflector, and the shutter on the light transmitting portion of the right first additional reflector shields the light from the left first additional reflector to the right second additional reflector.

4. The vehicle headlamp according to claim 1, wherein a reflecting face of the left second additional reflector is formed in an elliptical curved surface with a first focal point in the vicinity of the second focal point of the reflecting face of the right first additional reflector, and a reflecting face of the right second additional reflector is formed in an elliptical curved surface with a first focal point in the vicinity of the second focal point of the reflecting face of the left first additional reflector.

5. The vehicle headlamp according to claim 1, wherein a vertical sectional shape in parallel to the optical axis of the reflecting face of the left second additional reflector is formed in an elliptical shape with a first focal point in the vicinity of the second focal point of the reflecting face of the right first additional reflector, and a second focal point at a point located nearly flush with a lower edge of the reflecting face of the left second additional reflector ahead of the first focal point of the reflecting face of the left second additional reflector by a predetermined distance, and a vertical sectional shape in parallel to the optical axis of the reflecting face of the right second additional reflector is formed in an elliptical shape with a first focal point in the vicinity of the second focal point of the reflecting face of the left first additional reflector, and a second focal point at a point located nearly flush with a lower edge of the reflecting face of the right second additional reflector ahead of the first focal point of the reflecting face of the right second additional reflector by a predetermined distance.

6. The vehicle headlamp according to claim 1, further comprising:

convex lenses respectively arranged ahead of the left and right second additional reflectors.

7. The vehicle headlamp according to claim 1, wherein the pair of first additional reflectors and the pair of second additional reflectors are arranged as two sets thereof in a nearly vertically symmetrical positional relationship with respect to the optical axis.

* * * * *